US005163386A

United States Patent [19]

Schechter

[11] Patent Number: 5,163,386

[45] Date of Patent: Nov. 17, 1992

[54] VARIABLE STROKE/CLEARANCE VOLUME ENGINE

[75] Inventor: Michael M. Schechter, Farmington Hills, Mich.

[73] Assignee: Ford Motor Company, Dearborn, Mich.

[21] Appl. No.: 856,272

[22] Filed: Mar. 23, 1992

[51] Int. Cl.[5] ..... F02B 75/04

[52] U.S. Cl. ..... 123/48 B; 123/78 E

[58] Field of Search ..... 123/48 B, 78 E, 78 F, 123/197.1, 197.4

[56] References Cited

U.S. PATENT DOCUMENTS

| | | | |
|---|---|---|---|
| 1,572,918 | 2/1926 | Geddes | 123/78 F |
| 1,786,423 | 12/1930 | Cady | 123/78 F |
| 1,901,263 | 3/1933 | Ruud | 123/78 F |
| 2,822,791 | 2/1958 | Biermann . | |
| 3,633,552 | 1/1972 | Huber | 123/48 B |
| 4,131,094 | 12/1978 | Crise | 123/78 E |
| 4,437,438 | 3/1984 | Mederer | 123/78 E |
| 4,538,557 | 9/1985 | Kleiner et al. | 123/78 E |
| 4,917,066 | 4/1990 | Freudenstein et al. | 123/48 B |
| 4,957,069 | 9/1990 | Mederer | 123/48 B |

*Primary Examiner*—David A. Okonsky

*Attorney, Agent, or Firm*—Jerome R. Drouillard; Roger L. May

[57] ABSTRACT

An automotive-type engine has each of the piston connecting rods connected to the engine crankshaft by means of a swing link that is pivoted at one end to the arm of a normally stationary crank; however, the crank can be rotated to change the clearance volume between the piston and the cylinder head or the stroke of the engine for best engine operation at each operating condition. A piston/plunger hydraulically interconnects the crank arm to a control means for permitting rotation of the crank arm by means of a number of cam-controlled pushrods operating on one-way check valves controlling flow of fluid from opposite ends of the chamber containing the piston/plunger.

7 Claims, 1 Drawing Sheet

VARIABLE STROKE/CLEARANCE VOLUME ENGINE

FIELD OF THE INVENTION

This invention relates in general to an automotive-type internal combustion engine. More particularly, it relates to one in which the compression ratio and the clearance volume are varied to obtain the best engine operating efficiency, control of emissions and other output benefits.

BACKGROUND OF THE INVENTION

Phase shifting of the intake and exhaust events of an engine causes the intake valve to close later or earlier than normal in the engine cycle to permit unthrottled operation at all or most part load conditions to reduce the engine pumping losses and obtain other output benefits. The air flow to the engine then is controlled by varying the volume of air trapped in the cylinder, which is accomplished by changing the timing of the late or early intake valve closing. As a result, the clearance volume should also be varied concurrently with the changes in trapped air volume if the desirable schedule of compression ratio as a function of engine load is to be maintained. This invention relates to an apparatus for changing the stroke clearance volume of an engine.

DESCRIPTION OF THE PRIOR ART

Methods of phase shifting the intake and exhaust camshafts or events to vary the timing of the intake valve closing are known in the prior art and, therefore, are not discussed as they are believed to be unnecessary for an understanding of the invention. Varying the clearance volume also is known in the prior art and is done in a variety of ways.

In U.S. Ser. No. 720,074, Variable Displacement and Compression Ratio Piston Engine, assigned to the assignee of this invention, a variable stroke construction is provided in which the piston connecting rod 28 is interconnected by means of a slide-type swing link mechanism 10 to the engine crankshaft 24. The swing link is pivotally mounted at 52 on a fixed structure and has hydraulic means 50 operable to change the stroke and clearance volume of the engine in response to alternating engine torsional impulses through the connecting rod to the swing link mechanism. The stroke and clearance volume are varied in this case by extending or retracting the length of the member 50, 56 connecting the connecting rod to the pivot 52. Member 50 contains a number of one-way check valves 70, 74 that are selectively operable to control the extension or retraction of the connecting rod 56. The pivot itself is not movable.

U.S. Pat. No. 2,822,791, Biermann, and U.S. Pat. No. 4,917,066, Freudenstein et al. are other examples of variable stroke/clearance volume engine constructions using swing link/beams for varying the stroke or clearance volume of the engine.

SUMMARY OF THE INVENTION

This invention is directed to a simple and easily constructed combination hydraulic and mechanical linkage mechanism for varying the stroke/clearance volume of an engine in response to the alternating torsional impulses of the engine that are applied through the piston and connecting rod mechanism. In brief, the motion of the engine piston is transmitted through the connecting rod to a swing link that has a slot with a slide that is connected to the engine crankshaft. The swing link in turn is pivoted at one end to the arm of a normally stationary crank, the arm projecting radially from the pivot shaft of the crank. The crank is selectively hydraulically controlled to be stationary, or free to move in response to the directional alternating torsional impulses applied to the swing link and crank. Rotation of the crank changes the clearance volume and the effective length of the stroke.

It is, therefore, a primary object of the invention to provide a simple, easily constructed mechanism for varying the engine stroke/clearance volume by utilizing a combined hydraulic/mechanical assembly in which the hydraulic control selectively permits or prevents the mechanical change in the store/clearance volume.

Other objects, features and advantages of the invention will become more apparent upon reference to the succeeding, detailed description thereof, and to the drawings illustrating the preferred embodiment thereof; wherein:

DESCRIPTION OF THE PREFERRED EMBODIMENT

Figure 1:
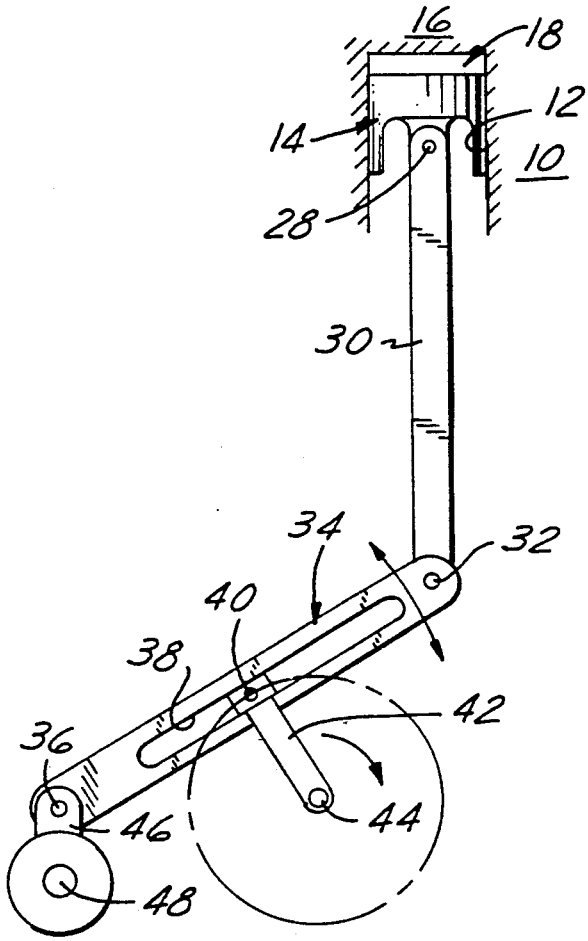
FIG. 1 is a schematic cross-sectional view of a portion of an engine embodying the invention.

FIG. 1 shows a portion 10 of the cylinder block of a conventional internal combustion engine containing a cylinder bore 12 in which is reciprocably mounted a piston 14. A cylinder head 16 closes the top of the bore. A conventional intake or exhaust valve, not shown, would be seated in an inlet port connecting an intake passage with the conventional intake manifold, also not shown.

The piston 14 is shown in its uppermost or extreme top dead center (TDC) position, indicating a defined clearance volume 18 between it and the cylinder head. It is this clearance volume that can be varied by the device of this invention.

The piston is pivotally connected at 28 to the upper end of a connecting rod 30. The lower end of the latter is pivotally connected at 32 to one end of a swing link 34 having a normally fixed pivot 36 at its opposite end. The swing link contains an axially extending slot 38 in which slidably moves a slide block 40 universally or pivotally connected to a throw 42 of the crankshaft 44.

As the piston reciprocates and the crankshaft rotates, the link 34 swings about the stationary pivot 36, and as long as the pivot remains stationary, the clearance volume 26 and the stroke will remain unchanged.

The pivot 36 in this case is a point or pin on the arm portion of a bell shaped crank 46 that is fixedly mounted on and keyed to a central shaft 48 for rotation therewith. As will be seen later, shaft 48 is selectively rotated by any suitable means, not shown, to adjust the clearance volume or stroke of the engine for best engine operation at each operating condition.

Figure 2:
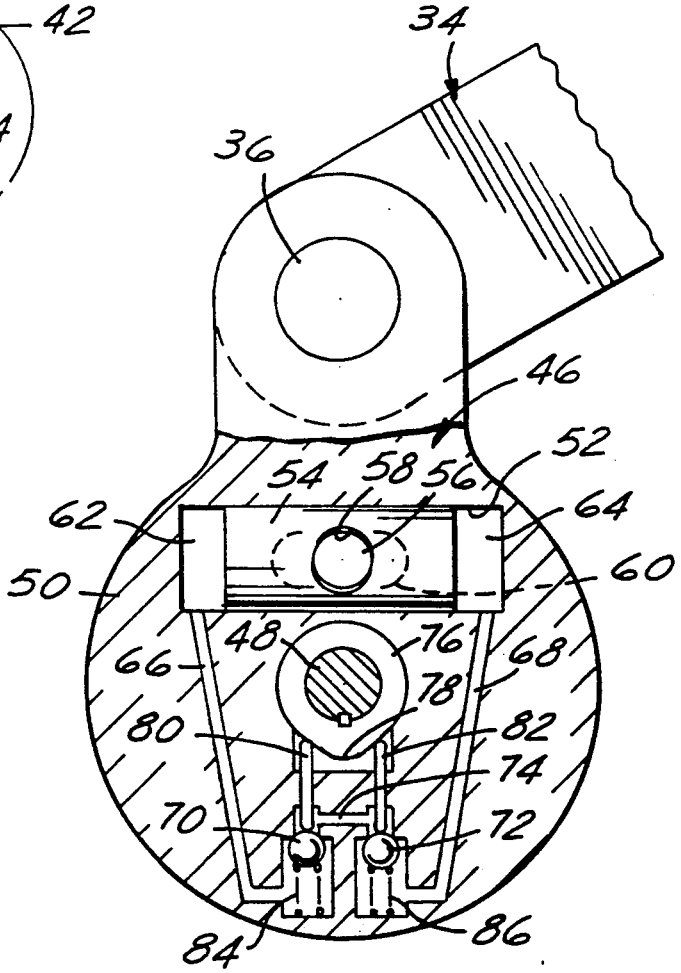
FIG. 2 is an enlarged cross-sectional view of a detail of FIG. 1.

More specifically, FIG. 2 shows the details of construction of the crank 46. The crank contains a hub 50 in which is provided a closed end hydraulic cylinder 52. The cylinder receives within it a double acting piston or plunger 54 that is mounted on a stationary pin 56 by means of an oval slot 58. Pin 56 world be fixed to any stationary part of the engine and prevents axial movement of the plunger or piston 54.

The crank hub 50 in turn has a horizontal slot 60 indicated by dotted lines permitting a limited arcuate relative movement between the chamber 52 defined by the cylinder and the piston or plunger 54. The opposite ends of the cylinder 62, 64 are adapted to be filled with fluid at all times. As long as there is no relative movement between the crank 46 and the plunger 54, the crank 46 and pivot 36 will remain stationary, thereby preventing the swing link 34 from moving to change the clearance volume or stroke of the engine.

The opposite ends 62, 64 of the cylinder are fluid interconnected by means of a Pair of fluid passages 66, 68; a pair of spring closed check valves 70, 72; and a central communicating passage 74. Keyed to the rotatable shaft 48 in this case is a cam 76 with a lobe 78. The lobe is adapted to alternatingly engage a pair of push rods 80, 82 engageable at times with the check valves 70, 72, respectively. In its neutral or central position shown, the lobe 78 allows the check valves 70, 72 to close under the force of their springs 84, 86.

During each compression and expansion stroke, the swing link 34 is subjected to a series of pushing and pulling forces that act in opposite directions on the crank 46 so that it is subjected to a continuous series of intermittent clockwise and counterclockwise torques. These apply pressure to chambers 62, 64, as the case may be, alternately as the torsional impulses are transferred to the crank, thereby alternately applying a higher force against one side of the plunger than the other during each impulse. As long as no fluid is permitted to enter or exit either end 62, 64 of the cylinder, no movement of the crank 46 will occur.

However, upon turning the control cam 76 clockwise, the push rod 80 will be moved downwardly to move open the ball check valve 70 against spring 84 and permit flow of fluid, for example, from chamber 62 through passage 66 past the open check valve 70 into passage 74 to open the check valve 72 and flow through passage 68 to the opposite chamber 64. With the plunger 54 stationary, the action will pivot crank 46 clockwise arcuately until it reaches a position in which the crank arm axis is again aligned vertically with the new position of cam lobe 78 to permit push rod 80 to again move upwardly and permit the closing of the passages 66, 74 by the ball valve 70. Reverse flow from chamber 64 at this time would be prevented by the seating of the ball valve 72. The closing of the check valve 70 at this time locks the crank in its new position with the clearance volume changed or adjusted as desired.

In practice, the control shaft 48 will be rotated so that the swing link will be moved to vary the clearance volume in the proper manner for best engine operation at each operating condition. In brief, then, turning the control cam clockwise moves the appropriate push rod to open the appropriate check valve and permit fluid flow from one chamber end to the other whenever the corresponding torque pulse acts on the crank 46. The crank arm also rotates in a counterclockwise direction in a similar manner whenever the shaft is turned counterclockwise.

Shaft 48 will run the entire length of the engine cylinder bank and would activate all of the control cams 48 for all of the cylinders simultaneously, thus providing for identical change in clearance volumes in all the cylinders. Rotation of shaft 48, therefore, would require very little effort, while the power motion of the crank 46 is performed by using only a fraction of the piston force.

From the above, it will be seen that the invention provides a simple yet effective combined hydraulic and mechanical mechanism for varying the clearance volume or stroke of an engine to maintain the desirable schedule of compression ratio as a function of engine load.

While the invention has been shown and described in its preferred embodiment, it will be clear to those skilled in the arts to which it pertains that many changes and modifications may be made thereto without departing from the scope of the invention.

I claim:

1. An automotive-type internal combustion engine having a piston reciprocably movable within the engine cylinder in a manner defining a normally fixed clearance volume between the piston and the engine cylinder head and a normally fixed stroke of the piston, an engine crankshaft, a rod operably connecting the piston to the crankshaft, and adjustable means between the rod and crankshaft to vary the clearance volume and the stroke of the piston, said adjustable means comprising a swing link arcuately pivotable about a normally stationary but movable pivot means at one end and pivotally connected to the rod adjacent its other end, slide connecting means pivotally connecting the swing link to the crankshaft for an arcuate oscillatory movement of the swing link upon rotation of the crankshaft to reciprocate the piston, movement of the pivot means pivoting the swing link with respect to the slide connecting means to move the connecting rod to change the clearance volume, and control means operable to control the movement of the pivot means to change the clearance volume, the pivot means being movable at times in an arcuate direction in response to the torque impulses of the engine applied through the piston and connecting rod to the swing link and pivot means to change the stroke of the piston and the clearance volume and means to render operable the control means.

2. An engine as in claim 1, wherein the pivot means comprises a crank pivotally mounted on a normally stationary but rotatable shaft for an arcuate movement relative thereto, and a crank arm projecting radially outwardly therefrom, means pivotally connecting the crank arm to the swing link, the control means including hydraulic control means operable to prevent pivotal movement of the crank relative to the shaft so long as the shaft remains stationary.

3. An engine as in claim 2, the hydraulic control means including a plunger means reciprocably mounted in a closed chamber containing fluid, means connecting opposite ends of the chamber to each other whereby relative movement between the piston and chamber effects a transfer of fluid from one end of the chamber to the opposite and vice versa, means fixedly connecting one of the plunger means and chamber to the crank, and holding means fixing the other of the plunger means and chamber stationary whereby the application of engine torque impulses to the crank pressurizes the one or opposite end of the chamber as a function of the direction of application of the torque impulses for relative movement at times between the plunger and chamber for movement of the crank in that direction to change the clearance volume, and other means associated with the shaft operable to block or permit the transfer of fluid from the opposite ends of the chamber.

4. An engine as in claim 3, the other means including one-way check valves associated with each side of the chamber for controlling flow of fluid to and from the respective ends of the chamber, and cam means operable upon rotation of the shaft to alternatingly open the check valves to permit the flow of fluid between ends of the chamber.

5. An engine as in claim 4, the shaft being selectively rotatable.

6. An engine as in claim 4, the shaft being rotatable to operate the check valves to rotate the pivot means and thereby change the clearance volume for best engine operation at each operating condition.

7. An engine as in claim 4, the means connecting opposite ends of the chamber comprising fluid passage means containing the one-way check valves, the valves facing one another whereby fluid flow in one direction opens one valve and closes the other and vice versa, push rod means engageable with each of the check valves and selectively movable to open the valve associated therewith, the cam means being mounted on the shaft for rotation therewith and engaging the push rods for alternate actuation thereof.

* * * * *